US009865237B1

(12) United States Patent
Karapetyan

(10) Patent No.: US 9,865,237 B1
(45) Date of Patent: Jan. 9, 2018

(54) MOUTHPIECE FOR WIND MUSICAL INSTRUMENT

(71) Applicant: Armen Karapetyan, Los Angeles, CA (US)

(72) Inventor: Armen Karapetyan, Los Angeles, CA (US)

( * ) Notice: Subject to any disclaimer, the term of this patent is extended or adjusted under 35 U.S.C. 154(b) by 0 days.

(21) Appl. No.: 15/530,617

(22) Filed: Feb. 8, 2017

(51) Int. Cl.
*G10D 9/02* (2006.01)

(52) U.S. Cl.
CPC ..... *G10D 9/02* (2013.01); *G10D 9/023* (2013.01)

(58) Field of Classification Search
CPC ..... G10D 9/02; G10D 9/023
See application file for complete search history.

(56) References Cited

U.S. PATENT DOCUMENTS

| | | | | |
|---|---|---|---|---|
| 2,374,579 | A * | 4/1945 | Brilhart | G10D 9/023 84/383 A |
| 2,388,822 | A * | 11/1945 | Brilhart | G10D 9/023 84/383 A |
| 7,439,429 | B2 | 10/2008 | Wood | |
| 7,563,970 | B2 | 7/2009 | Laukat et al. | |
| 7,872,186 | B1 * | 1/2011 | Tatman | G10D 9/023 84/380 R |
| 7,884,273 | B2 | 2/2011 | Hagstrom | |
| 8,039,721 | B2 | 10/2011 | Wold | |

* cited by examiner

*Primary Examiner* — Robert W Horn

(57) ABSTRACT

The present mouthpiece for wind musical instrument generally provides a wider range of the tone in the wind musical instruments. An improved mouthpiece for wind musical instrument includes a first and a second reeds coupled by a coupler at the musical instrument side, a first and a second apertures in the first and second reeds respectively, a decorative bolt with a first and a second washers, a decorative nut, and a spring.

4 Claims, 4 Drawing Sheets

VIEW 28-28

MOUTHPIECE FOR WIND MUSICAL INSTRUMENT

FIELD OF THE INVENTION

A mouthpiece for wind musical instrument provides a controllable mouthpiece, widening range of the tone in the wind musical instruments.

This invention is generally related to a controllable mouthpiece for wind musical instrument, and specifically, to a double-reed type of mouthpiece used to produce sound on various wind musical instruments.

BACKGROUND OF THE INVENTION

The various types of the mouthpieces are well known. The mouthpieces containing a single reed and/or mouthpieces entirely consisting of a double-reed are also well known in the field of the wind musical instruments, and particularly in the woodwind musical instruments.

As it is well known, the mouthpieces are intended to produce sound on the wind instruments. It is also well known, that a reed is a thin strip of material which vibrates to produce a sound on a musical instrument. The reeds of most wind musical instruments may be made from bamboo. Also known, that the reeds of most woodwind musical instruments are usually made from *Arundo donax* ("Giant cane") or bamboo too, or in the modern time even from the synthetic materials.

The single reeds are generally used on the mouthpieces of the wind musical instruments, for example, such as clarinets and saxophones. The back of the reed is flat and is placed against the mouthpiece, the rounded top side tapers to a thin tip. Such reeds are roughly rectangular in shape except for the thin vibrating tip, which is curved to match the curve of the mouthpiece tip. All single reeds are configured similarly but distinguished in size to fit each musical instrument's mouthpiece. Reeds designed for the same instrument may look identical to each other, but may vary in hardness ("thickness" or "strength"). Hardness is generally measured on a scale of 1 through 5 from softest to hardest. This is not a standardized scale and reed strengths vary by manufacturers. The thickness of the tip and heel and the profile in between affect the sound and playability. Cane of different grades (density, stiffness), even if cut with the same profile, will also respond differently. This is due to the natural differences in the density of the cane fibers. As it is known, the cane used to make reeds for saxophone, clarinet, and other single reed instruments is a special cane grown in the southern coastal regions of France. Once the cane is cut, it must lay out and dry in direct sunlight for about a month. The cane is rotated regularly to ensure proper and complete drying. Once dry, they are taken to be stored. As the cane is needed, it is pulled from the storage facility and delivered to the factory. At the factory, the cane is cut into tubes. The tubes are selected by diameter and walls' density. Further, the tubes are cut into "splits" which are transformed into so called "reed blanks". The blanks are then tapered and profiled using special blades or machines into reeds. After all these steps, the strength of the reeds is graded by machines.

Double-reeds are used on the oboe, oboe d'amore, English horn, bass oboe, Heckelphone, bassoon, contrabassoon, sarrusophone, shawm, bagpipes, nadaswaram, shehnai and duduk (doo-dook). The double-reeds are typically not used in conjunction with a mouthpiece, e.g. such as used on clarinets and saxophones, and other similar musical instruments. A single reed consists of one piece of cane which vibrates against a mouthpiece made of metal, hardened rubber, resin, or some other material. The term double-reeds can also refer collectively to the class of musical instruments which use double-reeds. There are several differences, the most obvious being size, between various types of double-reeds, for example, between that for a bassoon and that for an oboe or a cor anglais (sometimes called an English horn).

For bassoon reeds, tubes of this cane are first split lengthwise then gouged to a certain thickness. The chosen piece of cane is then cut to shape and the centre portion is thinned (profiled). The cane is folded end to end to form the two blades of the reed. The unprofiled end of the cane is shaped into a tube with the aid of a mandrel and bound with three (or four in some reed making techniques) strategically placed wires. A turban made out of thread is added on the third wire. It provides a hand hold for the reed that isn't a sharp wire. The folded tip is cut off to allow the blades to vibrate and final adjustments to the interior of the reed using a reamer, and to the exterior using a reed-scraping knife, are carried out. The reed is then ready to fit to the bocal of the bassoon. Note that there are many schools of thought and processes for making reeds.

The construction of double-reeds for the oboe family of instruments is similar in principle: like the bassoon's reeds, they consist of two pieces of cane fastened together with an opening at the tip. However, because the oboe does not have a bocal, the cane must be fastened to a metal tube (the staple), the lower half of which is normally surrounded by a piece of cork. The staple is then inserted into the farrow at the upper end of the oboe.

There are many different methods of making reeds and many variations of design have been developed. Players can buy reeds either ready-made, or in various stages of formation, such as part-scraped, reed blanks, or buy the staples and cane separately. Cane is sold in several forms: as tubes, gouged, gouged and shaped, or gouged and shaped and profiled. Bassoon cane has the further option of being profiled before purchase. Even if the cane from southern France is considered as the best, the cone from several different regions is also used in reed making. There are also many options with regard to staples, shaping equipment, and so forth, which all have a subtle effect on the tone quality a reed will produce.

The duduk is an ancient double-reed woodwind flute made of apricot wood. It is indigenous to Armenia. The unflattened reed (cane) and cylindrical body produce a sound closer to the English horn than to more commonly known double-reeds. Unlike other double-reed instruments like the oboe or shawm, the duduk has a very large reed proportional to its size. The duduk is a double-reed woodwind musical instrument with ancient origins, having existed since at least the fifth century. The earliest instruments similar to the duduk's present form are made of bone or entirely of cane. Today, the duduk is exclusively made of wood with a large double-reed, with the body made from aged apricot wood. The particular tuning depends heavily on the region in which it is played. It is known, that in the twentieth century, the Armenian duduk began to be standardized diatonic in scale and single-octave in range. Accidentals, or chromatics are achieved using fingering techniques. The instrument's body also has different lengths depending upon the range of the instrument and region. The reed is made from one or two pieces of cane in a duck-bill type assembly. Unlike other double-reed instruments, the reed is quite wide, helping to give the duduk both its unique, mournful sound, as well as its remarkable breath requirements.

In the modern time, duduk may be made of maple or other wood. The duduk is noticed in a few of the U.S. Patents, i.e.: U.S. Pat. Nos. 7,439,429; 7,563,970; 7,884,273 and 8,039,721.

All known prior art describes the uncontrollable double-reed mouthpieces of the wind musical instruments.

Thus, there is a need in the art for the improved double-reed mouthpiece (further may be called as "mouthpiece"), providing control of the tone (widening the variety of the tones) on the woodwind musical instruments, for example, such as duduk and other similar musical instruments.

OBJECT AND ADVANTAGES OF THE INVENTION

Accordingly, several objects and advantages of the present invention are to provide the controllable mouthpiece (double-reed mouthpiece) of the woodwind musical instruments.

It is another object of the invention to provide a mechanical control of the tone on the woodwind musical instruments, by the mechanical control of the gap between two reeds of the double-reed mouthpiece of the woodwind musical instruments.

It is still another object of the invention to widen the variety (range) of the tones on the wind musical instruments.

DESCRIPTION OF THE DRAWING

In order that the invention and the manner in which it is to be performed may be more clearly understood, embodiments thereof will be described by way of example with reference to the attached illustrations and drawings, of which.

SUMMARY OF THE INVENTION

An improved mouthpiece for wind musical instrument provides a possibility to control the tone on the woodwind musical instruments widening range of tones. An improved mouthpiece for wind musical instrument includes a first and a second reeds coupled by a coupler at the musical instrument side, a first and a second apertures in the first and second reeds respectively, a decorative bolt with a first and a second washers, a decorative nut, and a spring.

DESCRIPTION OF THE PREFERRED EMBODIMENTS

The description of an improved mouthpiece for wind musical instrument will be done in statics (as if the components of the improved apparatus are suspended in the space) with description of their relative connections/coupling to each other. The description of the functional operations of an improved mouthpiece will be done hereinafter.

Figure 1:
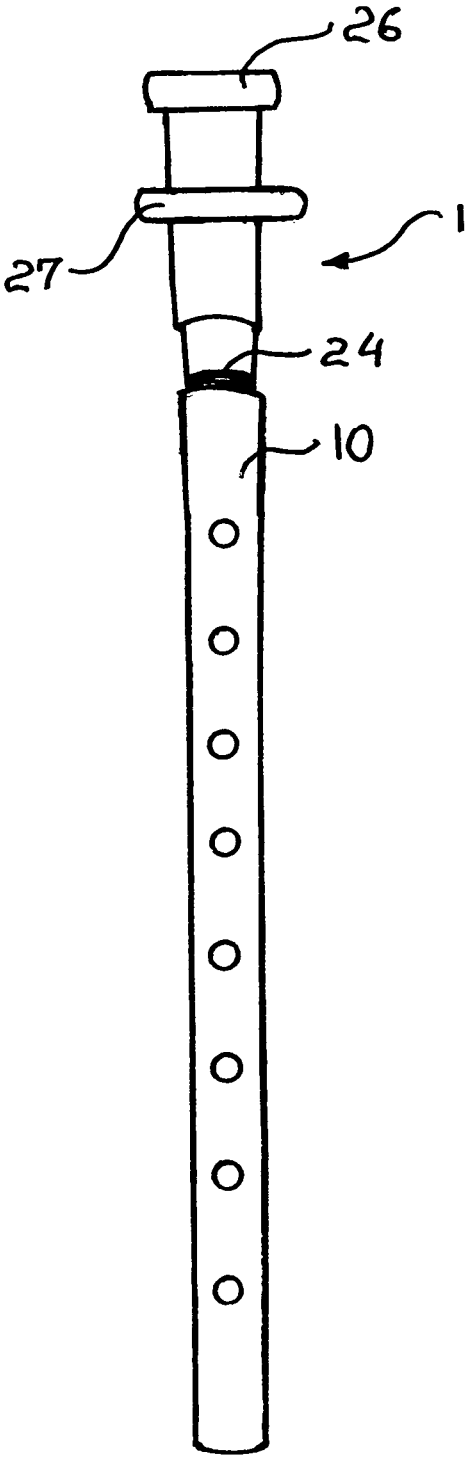
Fig. 1 (Prior Art)
FIG. 1 is a color illustration of the known duduk (prior art).
Figure 2:
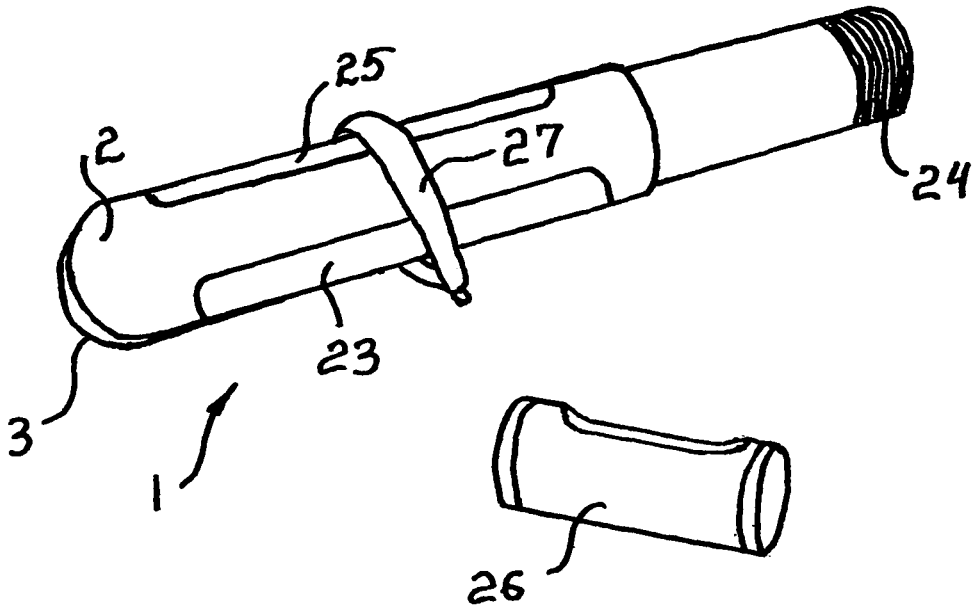
Fig. 2 (Prior Art)
FIG. 2 is a color illustration of the known double-reed mouthpiece of the duduk (prior art).
Figure 3:
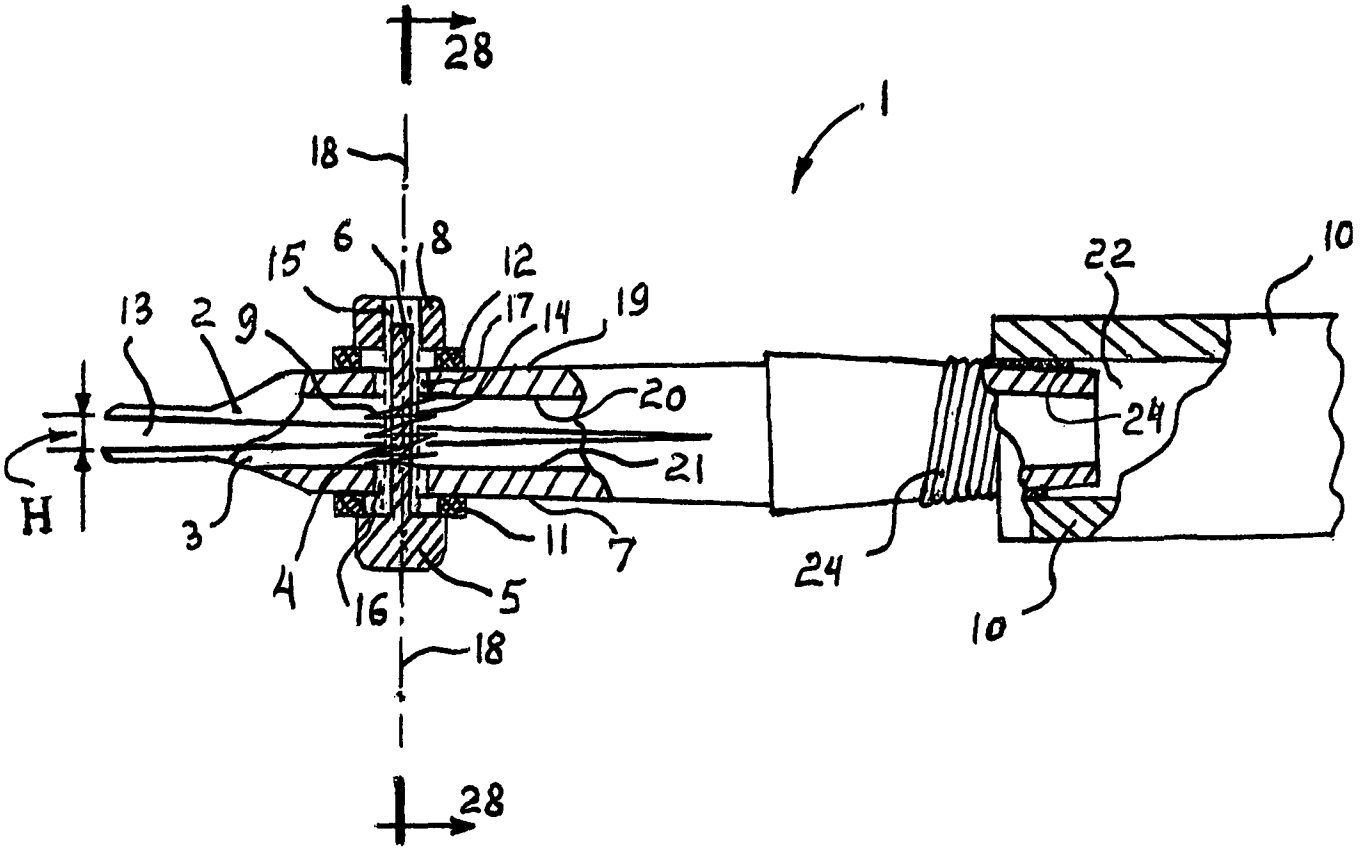
FIG. 3 is a simplified side view drawing of an improved double-reed mouthpiece for wind musical instruments.
Figure 4:
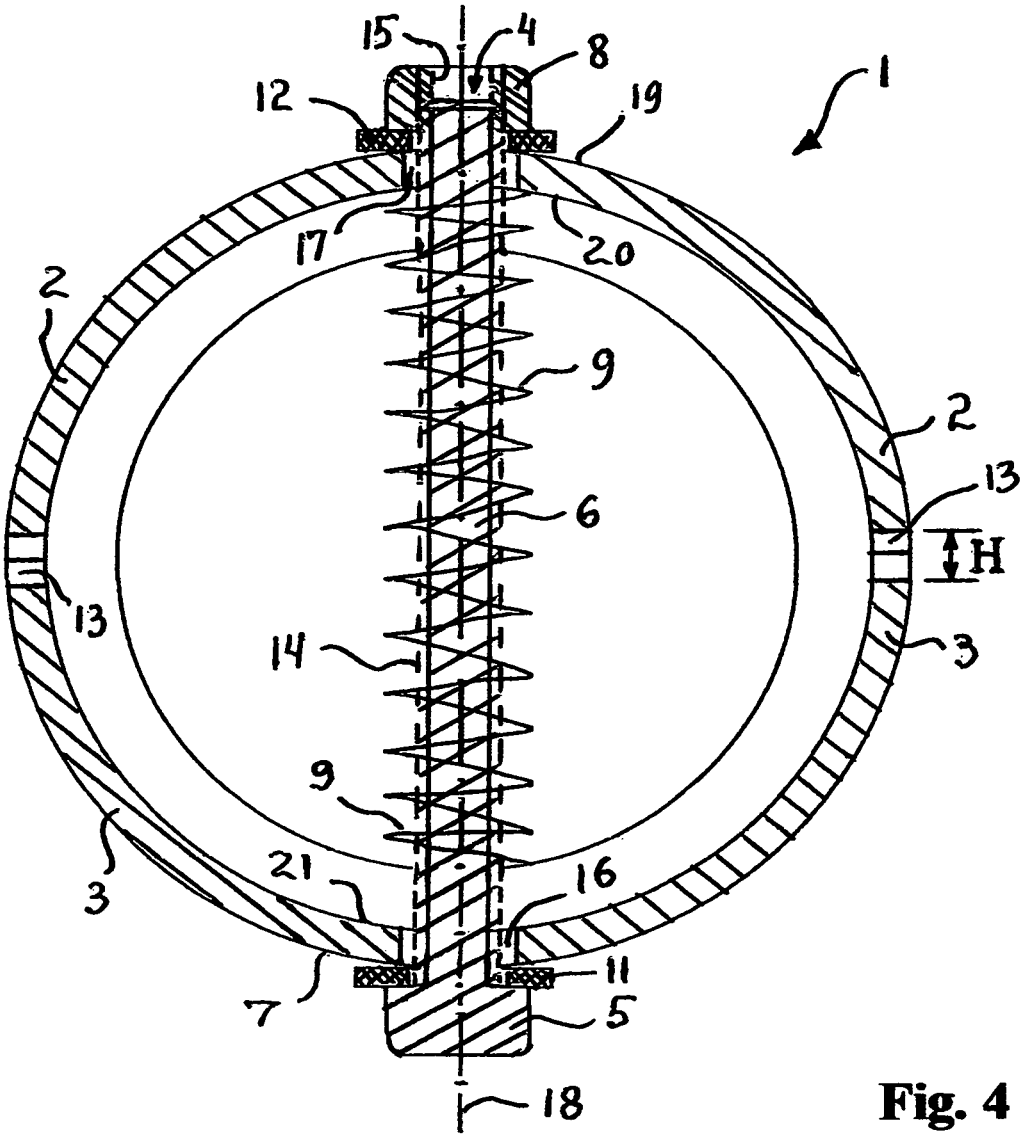
FIG. 4 is a simplified drawing of cross-sectional view 28-28 of an improved double-reed mouthpiece.

The prior art is presented by FIGS. 1 and 2 [used from the publicly available source(s)], wherein is depicted a duduk (also known as "Armenian duduk"), and an improved mouthpiece is presented by the drawings in FIGS. 3 and 4.

The FIGS. 3 and 4 illustrate an improved double-reed mouthpiece 1.

Referring to FIG. 3 and to FIG. 4, the first reed 2 and the second reed 3 are two reeds of the cane with the narrowed thickness at the side intended for musician's mouth (not shown). The mouthpiece 1 is made of one solid piece of cane split at the musician mouth side for two reeds (first reed 2 and second reed 3), as it is shown in FIGS. 2-4.

As it is shown in FIG. 2, the first reed 2 and the second reed 3 are coupled by a first coupler 23 and a second coupler 25. The other side of the mouthpiece 1 is inserted in the opening 22 of the musical instrument 10. The first reed 2 includes a first aperture 16, and the second reed 3 includes a second aperture 17. The first aperture 16 and the second aperture 17 are coaxial along an axis 18.

The mouthpiece 1 also includes a decorative bolt 4 comprising a head 5 rigidly connected to the threaded portion 6. The decorative bolt 4 comprises a first washer 11 at the side of the head 5. The threaded portion 6 is inserted along axis 18 through the spring 9, located between first aperture 16 and second aperture 17, as it is shown in FIGS. 3 and 4. The diameter of the spring 9 is bigger than the diameter of the decorative bolt 4, and slightly bigger than the diameters of the first 16 and second 17 apertures. The second washer 12 is inserted on the threaded portion 6 extended over the upper surface 19 of the first reed 2, and is rested on the upper surface 19 of the first reed 2. The first washer 11 is located between the head 5 of the decorative bolt 4 and the lower surface 7 of the second reed 3, as it is also shown in FIGS. 3 and 4.

The mouthpiece 1 also comprises a decorative nut 8. The outer thread 14 of the threaded portion 6 of the decorative bolt 4, which is extended over the upper surface of the first reed, is coupled with the decorative nut 8 by the inner thread 15 of the nut 8.

The improved mouthpiece operates as follows below. As it has been noted hereinabove, the reed is a thin strip of material which vibrates to produce a sound on a wind musical instrument. The double-reed mouthpiece produces a sound by vibration of two thin strips, depending on the gap between them. The width "H" of the gap 13, formed between lower surface 20 of the first reed 2 and upper surface 21 of the second reed 3, is controlled by the rotation of the decorative nut 8. The tone on the musical instrument 10 depends on the tightening or loosening the decorative nut 8.

All components (parts/portions) of the tone controlling mechanism of the improved mouthpiece 1 can be made from any reasonable material, appropriate for the wind musical instrument (e.g., wood, plastic and even metal, etc.), but for the woodwind musical instruments (for example, such as duduk and other similar musical instruments) is preferably from the wood (except the spring 9). The first 11 and second 12 washers can be made of cork, plastic or even rubber, etc., but again, the wood is preferable. The couplers 23 and 25 (FIG. 2) can be represented by any suitable soft, flexible material (preferably self-adhesive). The coupling of the mouthpiece 1 with the musical instrument 10 is traditionally provided via sewing thread 24 tightly wound around mouthpiece, but any suitable material can be used too. The head 5 of the decorative bolt 4 and decorative nut 8 can be preferably configured in a non-traditional shape. For example, the head 5 of the decorative bolt 4 and decorative nut 8 can have an aesthetic (decorative) design. The mouthpiece can be made of two divided separate (not shown) pieces (reeds) of cane, produced by splitting one piece of cane for two separated halves (not shown) along the axis 18 or can be made of one solid piece of cane split at the musician mouth side for two reeds, as it is shown in FIGS. 2-4.

Additionally, the humidifier (not shown) can be inserted in the end of the instrument (e.g., duduk, etc.) during storing. The role of humidifier can be played, for example, by the small capsule filled by water and having a small hole in it for slow water vaporizing without water leakage.

Also, the thin separator (not shown), providing separation of the first reed 2 and second reed 3, when the cap 26 (FIGS. 1 and 2) is used at the time of storing. Such separator (not shown) keeps some distance (gap 13) between the first 2 and second 3 reeds during storing period. The cap 26 is coupled with a clamp 27 (FIGS. 1 and 2), which can be put on the mouthpiece during not playing music.

It is understandable, that the form/shape/configuration and size of the mouthpiece 1 and musical instrument 10, depicted in these illustrations and drawings, are the examples of the improved mouthpiece and can be of any traditional form and size or any other reasonable forms, sizes and their proportion, and those skilled in the art will readily observe that numerous structures, modifications and advantages of the improved mouthpiece made while retaining the teachings of the present invention, and not limited to the mouthpiece described herein.

As it is also understandable, the use of one of the terms for the mouthpiece's parts/compo-nents does not exclude the other meanings for the used terms and parts, if otherwise not specified. This description has many other terms for which this condition is applicable too.

Also, it should be understandable, that exemplification of the improved mouthpiece for wind musical instrument is simplified and presented conditionally, and may be represented by any similar structures continuing teaching of the improved mouthpiece of the present invention.

CONCLUSION, RAMIFICATION AND SCOPE

Accordingly the reader will see that, according to the invention, I have provided a mouthpiece for wind musical instrument, providing controllable mouthpiece, widening tone in the wind musical instruments.

An improved mouthpiece for wind musical instrument has various possibilities, considering variety of the wind musical instrument, and especially, considering variety of the double-reed woodwind musical instruments.

While the above description contains many specificities, these should be not construed as limitations on the scope of the invention, but as exemplification of the presently-preferred embodiments thereof. Many other ramifications are possible within the teaching to the invention. For example, an improved mouthpiece for wind musical instrument can be successfully used not only in the double-reed woodwind musical instruments, but in the single-reed mouthpiece for wind musical instruments, e.g. such as clarinets and saxophones, and other similar wind musical instruments.

Thus, the scope of the invention should be determined by the appended claims and their legal equivalents, and not by examples given.

There has thus been outlined, rather broadly, the more important features of the invention.

In this respect, it is understood that the invention is not limited in its application to the details of arrangements of the components/portions/elements set forth in the description and/or drawings. The invention is capable of other embodiments and of being practiced and carried out in various ways.

Also, it is to be understood that the phraseology and terminology employed herein are for the purpose of description and should not be regarded as limiting.

The persons of ordinary skills and/or creativity in the art will readily observe that numerous modifications and advantages of the improved device may be made while retaining the teachings of the invention.

As such, those skilled in the art will appreciate that the conception, upon which this disclosure is based, can readily be utilized as a basis for the designing of other structures, for carrying out the several purpose of the present invention. It is important, therefore, that the claims be regarded as including such equivalent constructions insofar as they do not depart from the spirit and scope of the present invention.

THE DRAWING REFERENCE NUMERALS

1. a mouthpiece;
2. a first reed;
3. a second reed;
4. a decorative bolt;
5. a head of the decorative bolt 4;
6. a threaded portion of the decorative bolt 4;
7. a lower surface of the second reed 3;
8. a decorative nut;
9. a spring;
10. a musical instrument;
11. a first washer;
12. a second washer;
13. a gap;
14. an outer thread of the decorative bolt 4;
15. an inner thread of the decorative nut 8;
16. a first aperture;
17. a second aperture;
18. an axis;
19. an upper surface of the first reed 2;
20. a lower surface of the first reed 2;
21. an upper surface of the second reed 3;
22. an opening;
23. a first coupler;
24. a sewing thread;
25. a second coupler;
26. a cap;
27. a clamp;
28-28 a cross-sectional view of an improved double-reed mouthpiece.

What is claimed is:

1. A mouthpiece for a wind musical instrument comprises a first reed including a first aperture;

a second reed, including a second aperture, wherein said second reed is coupled with said first reed by a coupler at a side of said mouthpiece which is insertable in an opening of said wind musical instrument;

a decorative bolt comprising a head rigidly connected to a threaded portion of said decorative bolt;

a first washer located at the side of said head of said decorative bolt between said head of said decorative bolt and a lower surface of said second reed, a spring, located between said first aperture and said second aperture, wherein a diameter of said spring is bigger than a diameter of said decorative bolt and slightly bigger than a diameter of said first aperture and a diameter of said second aperture, and wherein said threaded portion is inserted along an axis through said spring;

a second washer inserted on said threaded portion, extended over an upper surface of said first reed, and rested on an upper surface of said first reed;

a decorative nut, an inner thread of which is coupled with an outer thread of said threaded portion which is extended over said upper surface of said first reed, wherein said decorative nut provides a desirable gap between a lower surface of said first reed and an upper surface of said second reed.

2. The mouthpiece of claim 1, wherein said decorative bolt and said decorative nut are made of wood.

3. The mouthpiece of claim 2, wherein said decorative bolt and said decorative nut are further made of plastic material.

4. The mouthpiece of claim 2, wherein said decorative bolt and said decorative nut are further made of metallic material.

* * * * *